US009327937B2

(12) United States Patent
Gormley

(10) Patent No.: US 9,327,937 B2
(45) Date of Patent: May 3, 2016

(54) INERTIA POWERED PROPORTIONAL BRAKING MECHANISM

(75) Inventor: Edward A. Gormley, New Boston, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 109 days.

(21) Appl. No.: 13/537,114

(22) Filed: Jun. 29, 2012

(65) Prior Publication Data

US 2013/0001348 A1 Jan. 3, 2013

Related U.S. Application Data

(60) Provisional application No. 61/503,284, filed on Jun. 30, 2011.

(51) Int. Cl.
*B65H 75/30* (2006.01)
*B65H 59/04* (2006.01)

(52) U.S. Cl.
CPC ..... *B65H 75/30* (2013.01); *B65H 59/04* (2013.01)

(58) Field of Classification Search
CPC ..... B65H 75/30; B65H 59/04
USPC ..... 188/71.1, 17, 26, 58, 70 R, 184, 187; 192/94, 52.4, 52.5, 54.51; 242/396, 242/396.5, 396.6, 396.9, 285, 302, 303, 242/396.1–396.3, 381, 381.5, 422, 422.1, 242/422.3, 423, 423.1, 423.2
See application file for complete search history.

(56) References Cited

U.S. PATENT DOCUMENTS

| | | | | |
|---|---|---|---|---|
| 1,881,043 | A * | 10/1932 | Buwalda | 248/611 |
| 5,238,201 | A * | 8/1993 | Jonushaitis | 242/396.8 |
| 5,516,176 | A * | 5/1996 | Kimoto et al. | 296/35.1 |
| 5,624,357 | A * | 4/1997 | Englehart et al. | 482/72 |
| 7,048,265 | B2 * | 5/2006 | Huprikar | 267/141.1 |
| 7,520,486 | B2 * | 4/2009 | Kim | 248/636 |
| 2002/0178857 | A1 * | 12/2002 | Matsumiya | 74/493 |

FOREIGN PATENT DOCUMENTS

JP 2012072785 A * 4/2012

* cited by examiner

*Primary Examiner* — Thomas J Williams
*Assistant Examiner* — Mariano Sy
(74) *Attorney, Agent, or Firm* — Maine Cernota & Rardin; Andrew P. Cernota; Daniel J. Long

(57) ABSTRACT

A system is provided for braking rotational movement comprising: a rotatable member; a friction surface disposed on the rotatable member; a friction plate opposed to the friction surface, such that when the rotatable member rotates the friction plate is in contact with the friction surface; a rod, having at least a threaded portion, and the at least a portion of the rod being received within the rotatable member such that the rotatable member rotates about the rod and moves along the threaded portion towards the friction plate; and a compressive member, whereby a force is applied to the friction plate which increases with rotation of the rotatable member.

8 Claims, 1 Drawing Sheet

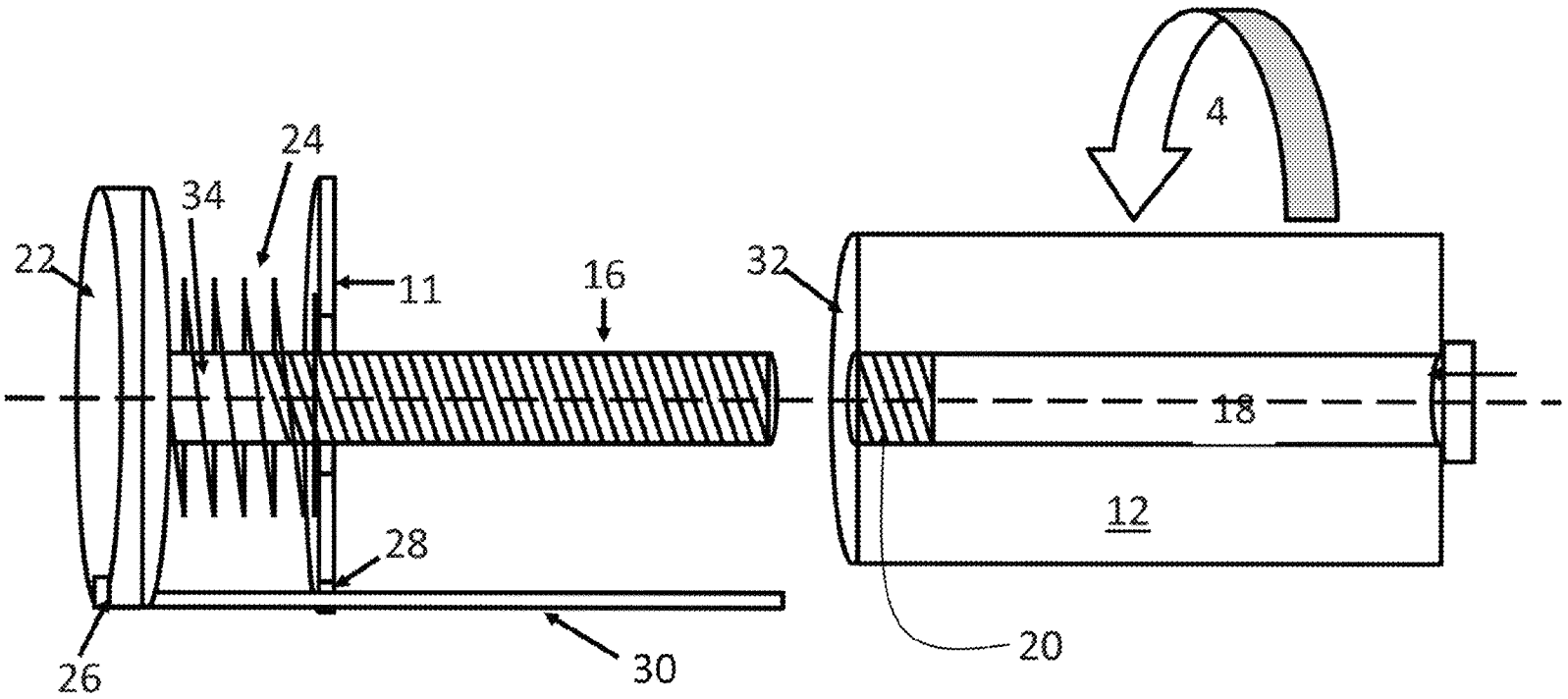
4
18
12
20
32
16
30
11
28
24
34
22
26

INERTIA POWERED PROPORTIONAL BRAKING MECHANISM

RELATED APPLICATIONS

This application claims the benefit of U.S. Provisional Application No. 61/503,284, filed Jun. 30, 2011. This application is herein incorporated by reference in its entirety for all purposes.

FIELD OF THE INVENTION

The present invention relates to braking mechanisms, more specifically to an inertia-powered braking mechanism for stopping a rotating spool or wheel.

BACKGROUND OF THE INVENTION

It is common practice to utilize a centrifugal braking mechanism to control the maximum speed of a spool or wheel as it rotates due to externally applied forces. One issue with this technique is the inability to slow the spool or drum at the end of the desired rotating period while external forces are still being applied.

Centrifugal brakes provide torque based on the speed of the rotating drum, spool, or wheel. A centrifugal brake cannot stop a rotating object in motion while external forces are providing a torque larger than that of the centrifugal brake. In the instance of a spool paying out line, as the end of the line wrapped on the spool approaches, the centrifugal brake cannot bring the spool to a stop.

What is needed, therefore, are techniques for a braking system that can apply a linear braking force proportional to the speed of the rotating spool and that can stop a rotating object while external forces are still being applied.

SUMMARY OF THE INVENTION

One embodiment of the present invention provides a system for braking rotational movement, the system comprising: a rotatable member; a friction surface disposed on the rotatable member; a friction plate opposed to the friction surface, such that when the rotatable member rotates the friction plate is in contact with the friction surface; a rod, having at least a threaded portion, and the at least a portion of the rod being received within the rotatable member such that the rotatable member rotates about the rod and moves along the threaded portion towards the friction plate; and a compressive member, whereby a force is applied to the friction plate which increases with rotation of the rotatable member.

Another embodiment of the present invention provides such a system wherein the compressive member is a spring.

A further embodiment of the present invention provides such a system wherein the compressive member is a ring of compressive material.

Yet another embodiment of the present invention provides such a system wherein the compressive material is selected from the group of compressive materials consisting of silicon, rubber, foam, and nylon.

A yet further embodiment of the present invention provides such a system embodiment of the present invention provides such a system wherein the rod is threaded along its entire length.

Still another embodiment of the present invention provides such a system wherein the rotatable member is a spool.

A still further embodiment of the present invention provides such a system wherein the friction plate comprises a metal.

Even another embodiment of the present invention provides such a system wherein the friction plate is coated with ceramic.

An even further embodiment of the present invention provides such a system wherein the friction plate comprises a frictional material selected from the group consisting of organic frictional materials; semi metallic frictional materials, mineral fibers, cellulose, aramid, polyacrylonitrile, chopped glass, steel and copper fibers, and combinations thereof.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIG. 1 is a block diagram illustrating a breaking mechanism configured in accordance with one embodiment of the present invention.

DETAILED DESCRIPTION

A braking mechanism is disclosed that applies a braking force linearly as a threaded shaft is taken in by the spool or wheel at the end of the rotating event. By applying the braking force in this manner, the spool is gradually decelerated and no advanced controls are needed.

In one embodiment, a threaded rod is inserted into the threaded center of the spool, wheel, or other mechanism with angular momentum. As the spool rotates, it moves the threaded rod through the center of the spool. At the end of the threaded rod is a friction surface connected to a backing plate with a compressive material or device in between with a line of compression along the axis of the threaded rod and the spool rotation axis. As the spool rotates, the friction surface will make contact with the end of the spool, creating friction between the surface and the spool. As rotations continue, the friction surface continues to advance and will be pulled harder against the spool. The result is a linear application of braking force proportional to the speed of the rotating spool and the compressive material stiffness.

Referring now to FIG. 1, a spool, drum, or wheel 12 may spin in the direction about a center axis 14. A partially threaded rod 16 is disposed in the hollow center 18 of the spool 12, and the partially threaded rod 16 may then engage the threaded insert 20. In one embodiment, the threaded rod 16 is threaded along its entire length, such an embodiment does not act to stop advancement of the back plate, compressive member or device, and friction surface. As the spool 12 continues to rotate, the threaded insert 20 draws the partially threaded rod 16 and the attached back plate 22 towards the spool 12. The assembly of the rod 16, attached back plate 22, compression spring 24, and friction plate 11 may then travel along the axis of the rotating spool 12, but may be prevented from rotating by holes, slots, or linear bearings 26, 28 along a surface, rod, or key 13. As the spool 12 rotates, the friction plate 11 may contact the friction surface 32 of the spool 12. The friction between the friction plate 11 and the friction surface 32 will create a torque in the opposite direction of the spool's rotation, decelerating the spool 12. As the spool 12 continues rotating, the compression spring 24 will begin to be compressed between the back plate 22 and the friction plate 11, increasing the normal force between the friction plate 11 and the friction surface 32 of the spool 12. This increased normal force increases torque as revolutions continue. After continued rotation, the section of shaft with no thread 34 will reach the threaded insert 20 and further travel of the partially threaded rod assembly will stop. A constant normal force between the friction plate 11 and the friction surface 32 will exist until the spool 12 has completely stopped or the friction between surfaces becomes zero.

In one embodiment, the frictional surface 32 and the friction plate 11 may be configured of ceramics or other materials that are configured for frictional braking such as those used in brake pads. Similarly, compressible materials may be used instead of the compression spring 24, examples of such materials include synthetic rubber, silicon, or other compressive materials that have will create a normal force between the frictional plate 11 and the friction surface 32.

One embodiment of the present invention provides a system for braking rotational movement, the system comprising: a rotatable member; a friction surface disposed on the rotatable member; a friction plate opposed to the friction surface, such that when the rotatable member rotates the friction plate is in contact with the friction surface; a rod, having at least a threaded portion, and the at least a portion of the rod being received within the rotatable member such that the rotatable member rotates about the rod and moves along the threaded portion towards the friction plate; and a compressive member, whereby a force is applied to the friction plate which increases with rotation of the rotatable member.

In various embodiments of the present invention the compressive member is a spring or a ring of compressive material. The compressive material, of various embodiments can be selected from the group of compressive materials consisting of silicon, rubber, foam, and nylon. As noted above, the rod may be partially threaded or is threaded along its entire length. The rotatable member may be a spool wheel, or other mechanism with angular momentum.

A still further embodiment of the present invention provides such a system wherein the friction plate comprises a metal or some other material and may be coated with ceramic. Suitable frictional materials can include organic frictional materials; semi metallic frictional materials, mineral fibers, cellulose, aramid, polyacrylonitrile, chopped glass, steel and copper fibers, and combinations thereof.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for braking rotational movement, the system comprising:

a spinning spool having rotational movement around an axis of said spinning spool;

a friction surface disposed on said spinning spool;

a friction plate opposed to said friction surface, such that when said spinning spool rotates said friction plate is in contact with said friction surface;

a backplate;

a rod extending from said backplate through said friction plate, having at least a threaded portion, and said at least a portion of said rod being received within said spool such that said spinning spool rotates about said rod and moves linearly along said threaded portion towards said friction plate;

a compressive member disposed between said friction plate and said backplate, whereby a force is gradually applied to said friction plate which increases with rotation of said spinning spool, gradually braking said rotational movement of said spinning spool; and an anti-rotation member extending from said backplate and engaging said friction plate such that said friction plate can move linearly parallel to a major axis of said rod but not rotate.

2. The system of claim 1 wherein said compressive member is a spring.

3. The system of claim 1 wherein said compressive member is a ring of compressive material.

4. The system of claim 3 wherein said compressive material is selected from the group of compressive materials consisting of silicon, rubber, foam, and nylon.

5. The system of claim 1 wherein said rod is threaded along its entire length.

6. The system of claim 1 wherein said friction plate comprises a metal.

7. The system of claim 1 wherein said friction plate is coated with ceramic.

8. The system of claim 7 wherein said friction plate comprises a frictional material selected from the group consisting of organic frictional materials; semi metallic frictional materials, mineral fibers, cellulose, aramid, polyacrylonitrile, chopped glass, steel and copper fibers, and combinations thereof.

* * * * *